United States Patent [19]

Kimura

[11] 4,448,236

[45] May 15, 1984

[54] APPARATUS FOR PRODUCING THIN METAL SHEET

[75] Inventor: Tomoaki Kimura, Hitachi, Japan

[73] Assignee: Hitachi, Ltd., Tokyo, Japan

[21] Appl. No.: 358,614

[22] Filed: Mar. 16, 1982

Related U.S. Application Data

[63] Continuation of Ser. No. 151,492, May 27, 1980, abandoned.

[30] Foreign Application Priority Data

May 25, 1979 [JP] Japan ..... 54-63860
May 25, 1979 [JP] Japan ..... 54-63868
Jul. 2, 1979 [JP] Japan ..... 54-82661

[51] Int. Cl.[3] ..... B22D 11/06
[52] U.S. Cl. ..... 164/423; 164/463
[58] Field of Search ..... 164/462, 463, 423, 427, 164/429, 284, 306, 150, 154, 113, 119, 120; 226/94, 95; 264/40.7, 216; 425/141, 145, 223, 224; 60/593; 271/310, 193, DIG. 2, DIG. 3; 222/394, 401; 91/4; 92/7

[56] References Cited

U.S. PATENT DOCUMENTS 1,868,115 7/1932 Mulligan ..... 242/67.1 R
3,608,615 9/1971 Conlon ..... 164/429 X
4,150,797 4/1979 Kataoka ..... 242/67.1 R

FOREIGN PATENT DOCUMENTS 20518 5/1910 United Kingdom ..... 164/429

*Primary Examiner*—Kuang Y. Lin
*Attorney, Agent, or Firm*—Beall Law Offices

[57] ABSTRACT

An apparatus for producing thin metal sheet by applying molten metal onto the peripheral surface of a rotary drum through a molten metal applying nozzle, and allowing the molten metal to be cooled and solidified on the peripheral surface of the drum. The molten metal applying nozzle is so disposed in relation to the rotary drum that the molten metal is applied upwardly to the peripheral surface of the rotary drum and that the direction of application of the molten metal intersects the peripheral surface of the rotary drum. This arrangement permits an easy setting of the nozzle in relation to the drum, as well as control of application of the molten metal, to make it possible to produce thin metal sheets of a large variety of thickness and high qualities, at an increased precision and production efficiency.

17 Claims, 6 Drawing Figures

APPARATUS FOR PRODUCING THIN METAL SHEET

This is a continuation of application Ser. No. 151,492, filed May 27, 1980, now abandoned.

BACKGROUND OF THE INVENTION

The present invention relates to an apparatus for producing thin metal sheet directly from a molten metal and, more particularly, to an apparatus of a type having a rotary drum to the surface of which a molten metal is applied through a nozzle and the molten metal is cooled and solidified on the drum surface to become a thin metal sheet.

A typical conventional apparatus for producing thin metal sheet has a rotary drum above which disposed is a crucible having heating coils wound therearound and adapted for storing molten metal. A pressure is applied to the molten metal in the crucible by a pressurizing fluid by means of a pump so that the molten metal is poured onto the surface of the rotary drum through a nozzle provided at the bottom of the crucible. The metal is then cooled and solidified on the surface of the drum to become a thin metal sheet. This type of apparatus is shown in the specification of the U.S. Pat. No. 4,077,462.

In this type of apparatus, it is necessary to prevent the molten metal from naturally flowing out of the nozzle by the force of gravity, in the early stage of operation in which the metal in the crucible is heated up to the desired temperature, or in the event where the production of the thin film is to be suspended. In such a case, it is necessary to take various measures such as stopping of the pump for supplying pressurizing fluid to the crucible while creating a vacuum at the space above the molten metal in the crucible by connecting a vacuum pump to the crucible, or to dispose a closure plate for stopping the flow of molten metal at the end of the pouring nozzle.

By these measures, however, it is not possible to completely stop the flow of the molten metal. In addition, there is a tendency that the end opening of the nozzle is clogged partially with the molten metal which is held in the nozzle end and naturally cooled during the suspension of operation. The partial clogging of the nozzle opening considerably hinders the uniform pouring of the molten metal over the entire width of the nozzle opening, resulting in a deterioration of the quality and yield. In addition, since a frequent replacement of the pouring nozzle is necessary, the efficiency of the production is considerably lowered.

In the prior art described above, the molten metal is applied in the downward direction from the pouring nozzle. In so far as the direction of application of the molten metal, there is a prior art which is constructed to direct the molten metal upward, as in the specification of U.S. Pat. No. 3,405,757. In this prior at, a molten metal charging chamber is defined by a pair of opposing rolls and a nozzle inserted close to the rolls. The molten metal, which is charged into the charging chamber, is solidified and then rolled by the pair of rolls to become a thin metal sheet. Namely, the molten metal is discharged aiming at the roll gap between two rolls which cooperate with the nozzle in defining therebetween a pouring basin. In this type of apparatus, it is necessary to work the nozzle having a complicated configuration at a high precision and to locate the nozzle accurately in the limited space between the nozzles in close proximity of the latter. In addition, the supply of the molten metal has to be done at a rate which correctly match the peripheral speed of the rolls, because the thickness of the thin metal sheet is determined by the size of the gap between two opposing rolls. If there is a shortage of the molten metal supply, the formed metal sheet will become porous. To the contrary, the molten metal supply at an excessively large rate will cause an overflow of the molten metal from the molten metal charging chamber, i.e. the pouring basin to clog the gap between the roll surfaces and the outer surface of the nozzle to interrupt the continuous production of the thin metal sheet. Further, troublesome works such as adjustment of the roll clearance, replacement with new nozzle and so forth are required for changing the thickness of the product sheet, inevitably resulting in the reduction of production efficiency.

It is, therefore, an important technical subject to be achieved to develop and realize an apparatus which will make it possible to produce thin metal sheets having high quality and large variety of thickness, e.g. about 30μ to 3 mm, at a high production efficiency.

In the thin metal sheet production apparatus incorporating a roll or rolls, higher production speed, i.e. a higher peripheral speed of the roll, is required as the thickness of the product sheet is reduced. In fact, the practical maximum peripheral speed of the roll is as high as 30 m/sec. Therefore, it is a key to the high precision of product sheet thickness to realize a high response characteristic of the control system for controlling the rate of the molten metal supply in response to the fluctuation of the sheet thickness.

It will be clear to those skilled in the art that a poor response characteristic results in a production of sheet to be rejected having low precision of thickness. Conventionally, it has been proposed and actually carried out to control the pressure in the crucible by a gas type pressure control valve. This valve, however, has an extremely low response characteristic and, accordingly, is not practical. Thus, it is also an important factor to be considered and achieved to obtain a sufficiently high response characteristic of the control system.

According to the above recited specification of the U.S. Pat. No. 3,405,757, the formed thin metal sheet is taken up by a take-up reel, through a guide device, after the delivery by the pair of rolls. There is a fear that a warp or deflection of the product sheet is used during the guiding, particularly when the sheet thickness is small and the speed of the sheet transfer is high. In consequence, an extraordinary effort has to be concentrated on the guide device, often incurring a difficulty in the continuous production of the thin metal sheet. Therefore, it is also an important subject to be achieved to realize a good guide and taking-up without being accompanied by the reduction of the production efficiency.

For a long-time operation for continuous production of the thin metal sheet, it is essential to continuously supply the molten metal from the crucible. In this connection, the aforementioned specification of the U.S. Pat. No. 3,405,757 discloses a molten-metal supplying device having a head tank in which a constant head of molten metal is maintained in relation to the lower end of the nozzle, the head tank being connected to the nozzle through a conduit. This device, however, has various disadvantages or shortcomings such as difficulty in control of the supply rate of molten metal at a high response characteristic due to the nature of the supply relying solely upon the head, necessity for precise control of the supply of molten metal to the tank, deterioration of quality of the product sheet due to oxidation off the molten metal because of a direct contact with the atmosphere, and so forth.

It has been proposed also to adopt a crucible having an airtight structure, in which a predetermined air or gas pressure is maintained to force out the molten metal through the nozzle onto the drum. Such a crucible, however, is still in need of a suitable device for continuously supplying the molten metal thereinto.

SUMMARY OF THE INVENTION

It is, therefore, a first object of the invention to provide an apparatus for producing thin metal sheet, capable of producing thin metal sheets of a large variety of thickness at a high efficiency.

It is a second object of the invention to provide an apparatus for producing thin metal sheet in which the rate of the molten metal supply is controlled at a high response to permit the thin metal sheet to be produced at a high precision.

It is a third object of the invention to provide an apparatus for producing thin metal sheet capable of taking up safely the produced metal sheet flowing at a high speed.

It is a fourth object of the invention to make it possible to supply the molten metal continuously to permit a long-term operation.

These and other objects, as well as advantages of the invention will become apparent from the following description when read in conjunction with the accompanying drawings, as well as the appended claims.

According to the invention, there is provided an apparatus for producing a thin metal sheet of a type in which molten metal is applied at a predetermined pressure onto the surface of a rotary durm through a nozzle, thereby to cool and solidify the molten metal on the roll surface to obtain a thin metal sheet, characterized in that the nozzle through which the molten metal is applied is so positioned and orientated in relation to the rotary drum that the direction of application of the molten metal through the nozzle is upward and intersects the surface of the drum.

DESCRIPTION OF THE PREFERRED EMBODIMENT

Figure 1:
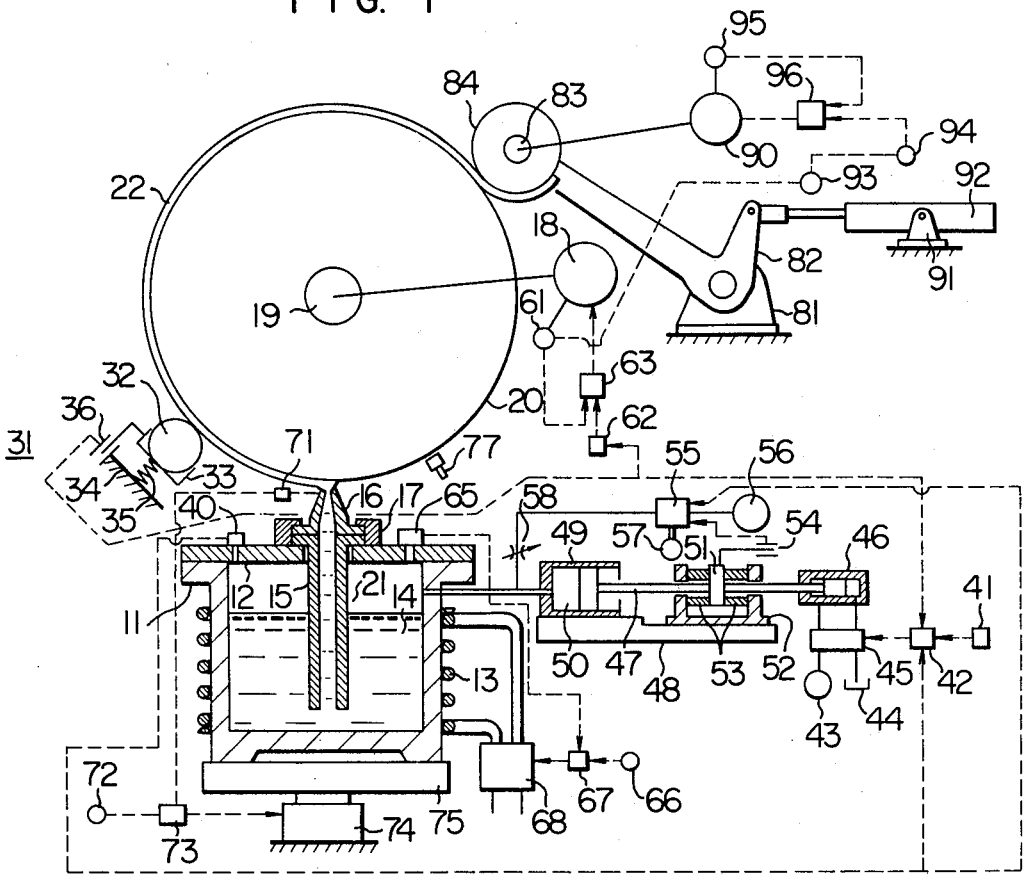
FIG. 1 shows, partly in section, the construction of whole part of an embodiment of the invention.

Referring first to FIG. 1 showing partly in section the whole part of an apparatus of the first embodiment of the invention, a crucible 11 has an upper opening through which a metal material is charged into the crucible 11. The upper opening is closed by a cover 12. Heater coils 13 wound around the crucible 11 heat and melt the metal in the crucible 11, so that the latter holds the metal 14 in the molten state therein. At the central part of the crucible 11, a molten metal applying pipe 15 extends from the level near the bottom of the crucible up to a level above the cover 12. A molten metal applying nozzle 16, the bore diameter of which is gradually reduced toward the open end, is attached to the upper end of the molten metal applying pipe 15.

The molten metal applying nozzle 16 is secured by a retainer 17 to the cover 12, while maintaining the communication with the molten metal applying pipe 15. The molten metal applying nozzle 16 is disposed as to oppose to the lower part of the peripheral surface of a drum 20 which is carried fixedly by a shaft 19 adapted to be rotatively driven by a drive motor 18.

The metal material placed in the crucible 11 is heated and melted as the heater coils 13 are energized to take the state of molten metal 14. A gas plenum 21 is formed on the surface of the molten metal 14 in the crucible 11. As an internal pressure P is created in the plenum 21, the molten metal 14 is forced into the molten metal applying pipe 15, and is then applied to the surface of the drum 20 through a nozzle 16. The molten metal on the peripheral surface of the drum 20 is then cooled and solidified to become a thin metal sheet 22.

Figure 2:
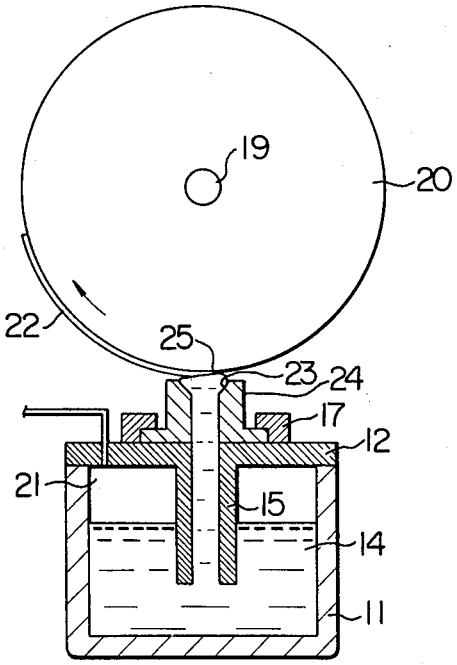
FIG. 2 is a partial sectional view of another form of nozzle for applying the molten metal.

The molten metal applying nozzle may be a nozzle 24 which is provided, as shown in FIG. 2, with a molten metal basin 23. In such a case, the molten metal 14 in the crucible 11 is forced into the molten metal applying pipe 15 under the presence of the internal pressure P and reaches the molten metal basin 23. The molten metal is then accumulated or pooled in the basin for contact with the surface of the drum 20. The molten metal in the basin 23, contacting the surface of the drum 20, is applied to the surface of the drum at a predetermined thickness and cooled and solidified to become a thin metal sheet 22.

In contrast to the aforementioned nozzle 16, the nozzle 24 has an opening which is shaped to maintain a sufficiently low flowing velocity of the molten metal flowing out of the nozzle, so that the wear of the opening is much reduced to ensure a high precision of thickness of the product sheet 22.

It is possible to arrange such that the molten metal is applied to the drum surface through a molten metal applying nozzle which is extended obliquely upwardly from a crucible which is disposed under the crucible.

A thickness sensor 31 for measuring the thickness of the metal sheet 22 is disposed on the region of the drum surface where the thin metal sheet is still adhering. This thickness sensor 31 is adapted to sense the thickness of the thin metal sheet and to produce an output which is used for a feedback control of the sheet thickness. Thus, the precision of the thickness control is enhanced as the point of thickness measurement approaches the position of the molten metal applying nozzle 16. However, since it is necessary that the thin metal sheet has been cooled and solidified by the time it reaches the point of thickness measurement, in the case of a sheet of 50$\mu$ thick, for example, the point of thickness measurement is spaced 100–200 mm or more from the position of the nozzle 16.

The thickness sensor 31 has a contact roller 32 supported by a bearing box 33 which in turn is supported resiliently by a measurement pedestal 34 through a compression spring 35. The arrangement is such that the position of the contact roller 32 (or bearing box 33) is detected by a detector 36 while pressing the metal sheet 22 against the drum surface by the contact roller 32. The measurement of the sheet thickness is carried out, using the drum surface as the reference, by means of detecting a position of the drum surface and a position of the contact roller 32 which are detected by the detector 36 attached to the measurement pedestal 34, and measuring the thickness of thin sheet and fluctuation thereof based upon the difference between said two positions.

If it is expected that the measurement of the sheet thickness is affected by the eccentricity of the drum surface or the like factor, the relationship between the rotational position of the drum 20 and the output of the detector 36 is beforehand obtained by rotating the drum while pressing the contact roller against the drum. Then, the measured value in the actual sheet thickness measurement is suitably corrected in accordance with the relationship obtained beforehand.

Also, when there is a fear that the thin metal sheet is deflected by the pressure exerted by the contact roller to affect the measured value of the sheet thickness, it is possible to precisely measure the sheet thickness while effecting a correction to compensate for the change of thickness attributable to the deflection. More specifically, when the thickness sensor 31 shown in FIG. 1 is used, the pressure of the contact roller 32 is calculated from the deflection of the compression spring 35. Then, in accordance with the result of the calculation of pressure, compensation is made for the change of the measured value due to deflection of the thin sheet 22 and, if necessary, compensation for the change of measured value attributable to the contact roller 32 and the drum 20, so that the true thickness of the sheet is measured at a high precision.

In the thickness sensor 31 shown in FIG. 1, it is possible to use a load cell in place of the spring 35, for directly measuring the roll pressure. In such a case, the sheet thickness is calculated from the overall spring constant of the load cell, contact roller 32, drum 20 and the thin sheet 22, and a correction or compensation is made with this calculated value to provide the true thickness of the thin metal sheet.

Figure 6:
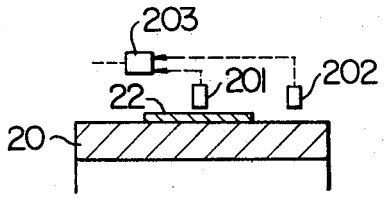
FIG. 6 shows a partial view taken along line VI—VI in FIG. 1.

The above described thickness sensors are contact type sensors employing a contact roller adapted to be pressed against the thin metal sheet. It is, however, possible to measure the thickness of the thin metal sheet by non-contact type thickness sensor, such as induction current type sensors 201 and 202 shown in FIGS. 1 and 6 that are of a conventional type making use of generation of eddy electric current, electric capacitance type sensor using electrostatic capacitance, sensors making use of reflection of electric or sonic wave, and so forth. In these non-contact type sensors 202 and 201, the distances of the drum 22 surface and the surface of the thin metal sheet 22 are measured from a reference point, respectively and the thickness of the thin metal sheet, as well as the fluctuation of the same, is measured by a conventional substractor 203 as the difference between these distances.

Hereinafter, a description will be made as to the control of the factors affecting the precision of thickness of the thin metal sheet 22 such as pressure P in the crucible, peripheral speed of the drum 20, temperature of the molten metal 14, and the gap between the molten metal applying nozzle 16 and the drum 20.

The internal pressure P in the crucible is directly controlled by controlled variable of a pressure controlling board 42 to which delivered are respective outputs from the thickness sensor 31 for detecting the thickness of thin metal 22, a crucible internal pressure sensor 40 for sensing the internal pressure P of the crucible and a pressure setting device 41 for setting the optimum value of the internal pressure P. These sensors are mounted in the cover 12. More specifically, a hydraulic cylinder 46 is actuated through a servo valve 45 by a hydraulic pressure source constituted by a hydraulic pump 43 and a tank 44, in accordance with the controlled variable from the pressure control board 42. The operation of the hydraulic cylinder 46 is transmitted through a piston rod 47 to a gas-pressure cylinder 49 mounted on a column 48 to cause a volume change of a cylinder chamber 50 of the gas-pressure cylinder 49. The gas-pressure cylinder 49 is in communication with the gas plenum of the crucible 11, so that the volume change of the cylinder chamber 50 directly controls the internal pressure P of the crucible.

The piston rod 47 is provided with a flange 51 both surfaces of which are in engagement with a rubbery resilient body 53 supported by the frame 52. The piston rod 47 is therefore subjected to a resilient resistance imparted by the rubbery resilient body 53 in whichever direction it may move, so that the control system as a whole has a high spring constant. In addition, since the rubbery resilient body absorbs and damps the vibration, the stability and, hence, the response characteristic of the control system are improved.

If the level of the molten metal 14 in the crucible is lowered or the gas is leaked from the crucible 11 or the gas-pressure cylinder 49 during the continuous production of the thin metal sheet, the pressure in the gas plenum 21 is gradually lowered to permit the piston rod to be gradually displaced to the left as viewed in FIG. 1. The control of internal pressure of the crucible by the gas-pressure cylinder 49 can no more be made after the piston rod has reached its stroke end. It is arranged, however, such that a valve 55 is operated to connect the interior of the crucible 11 to a pressurizing pump 56, in accordance with the output from the gas-pressure cylinder position sensor 54 coupled to the piston rod 47 and the output from the internal pressure sensor 40, thereby to charge the gas plenum 21 with the pressurizing fluid. In the event that the piston rod is moved to a position near the right-side stroke end as viewed in the drawings by an excessive charging of the pressurizing fluid, the valve 55 is operated for communication with a vacuum pump 57 to permit the excessive pressurizing fluid to be relieved. The piping containing the valve 55 includes an orifice 58 which reduces the influence of the high-speed operation of the gas-pressure cylinder 49 to which the valve 55 is subjected.

The peripheral speed of the drum 20 is controlled by adjusting the speed of the drive motor 18 in accordance with an instruction given by a speed controller 63 which receives the outputs from the thickness sensor 31, speed sensor 61 and a speed setting device 62.

The temperature of the molten metal 14 in the crucible 11 is effected by adjusting the electric current supplied to the heater coil 13 through a control of a coil power supply 68 in accordance with an instruction from a temperature controller 67 which receives the outputs from a temperature sensor 65 and a temperature setting device 66. It is also possible to arrange such that the temperature is controlled directly in relation to the thickness of the sheet 22, in accordance with the measured value of the thin metal sheet 22, by inputting the output from the thickness sensor 31 to the temperature controller 67.

The control of the gap between the molten metal applying nozzle 16 and the drum 20 is effected by vertically moving the pedestal 75 supporting the crucible 11 up and down through actuating a hydraulic cylinder 74 in accordance with an instruction given by a gap controller 73 which receives the outputs from a gap detecting sensor 71 and a gap setter 72. It is also possible to arrange such that the gap is controlled in direct relation to the sheet thickness in accordance with the measured value of the sheet thickness by inputting the output from the thickness sensor 31 to the gap controller 73.

Further, a temperature sensor 77 is disposed at a suitable position to oppose to the peripheral surface of the drum 20. The temperature of the drum 20 is controlled by blowing cooling air onto the drum 20 by means of a blower which is not shown, in accordance with the output from the temperature sensor 77. This control of the drum temperature permits a fine adjustment of the properties of the thin metal sheet 22.

The thin metal sheet 22, which has undergone the precise adjustment of thickness and fine adjustment of the properties, is then wound into the form of a coil by means of a take-up means which will be described hereinunder.

Figure 3:
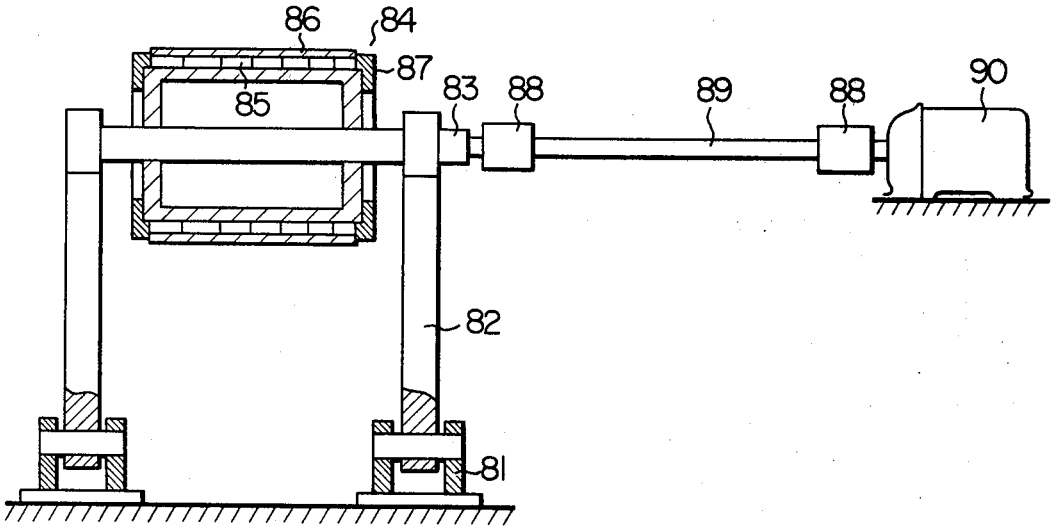
FIG. 3 is a partial sectional view of an essential part of the embodiment shown in FIG. 1, and shows a take-up drum in front elevation.

More specifically, as shown in a larger scale in FIG. 3, the take-up means includes a bracket 81 which supports an L-shaped rocker arm 82 which supports at its one end a rotary shaft 83 fixedly carrying a take-up drum 84.

A magnet 85 is disposed around the outer peripheral surface of a take-up drum 84. The outer peripheral surface of the magnet 85 is enclosed by a thin cover ring 86, while both side portions of the magnet 85 are restrained and held by caps 87 fixed to both side surfaces of the drum 84. This take-up drum 84 is disposed in such a manner as to be able to contact the sheet releasing portion of the drum on which the thin metal sheet 22 is cooled and solidified. The rotary shaft 83 of the take-up drum 84 is connected to a take-up motor 90 through a universal joint 88 and a coupling shaft 89. Namely, the take-up drum 84 is rotated by the driving power of the take-up motor 90 and, at the same time, attracts the leading end of the thin metal sheet 22 by the electromagnetic attracting force to start the taking-up of the thin metal sheet 22.

To one side of the rocker arm 82, connected is an end of a piston rod of a pressing cylinder 92 which in turn is supported by a bracket 91 in the same manner as a trunnion. This pressing cylinder 92 carries the rocker arm 82 rockably in such a direction as to press the take-up drum 84 toward the drum 20 and, as the take-up of the sheet 22 proceeds to increase the diameter of the coil of sheet 22 on the take-up drum, to move the take-up drum 84 away from the drum 20 by retracting the piston rod.

The torque of the take-up motor 90 is optimumly controlled by a torque controller 96 which receives the outputs from an acceleration/deceleration compensator 93 for adjusting the rotation speed of the take-up drum 84 in accordance with an acceleration or deceleration of the drum 20, a torque setting device 94 and a current sensor 95 for sensing the current in the take-up motor 90, thereby to maintain a constant tension in the thin metal sheet 22 during the taking-up thereof.

Since the take-up drum 84 constituting the taking-up means is provided with an attracting means constituted by a magnet 85, the leading end of the thin metal sheet 22 is caught without fail and, at the same time, an adequate coil compacting force is obtained at the starting of the taking-up, so that it is possible to smoothly start the taking-up of the thin metal sheet 22 which is delivered at a high speed.

Figure 4:
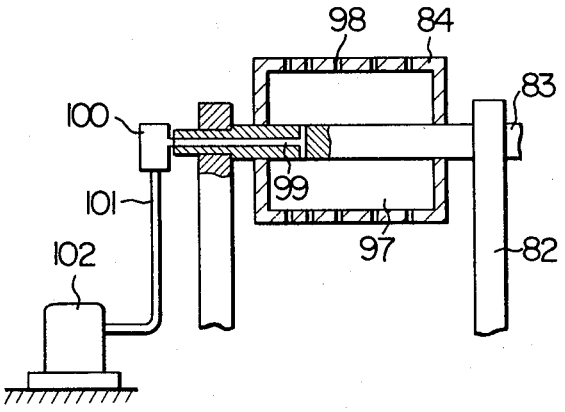
FIG. 4 is a partly sectioned front elevational view of another form of the take-up drum.

The attracting means on the take-up drum 84 may be constituted by a vacuum suction type device, instead of the magnetic device. More specifically, as shown in a larger scale in FIG. 4, a vacuum chamber 97 is formed in the take-up drum 84. A multiplicity of attracting ports 98 are formed in the cylindrical wall of the drum 84 to communicate the outer peripheral surface of the take-up drum 84 with the vacuum chamber 97. Also, an axial communication bore 99 is formed in the rotary shaft 83 fixedly carrying the take-up drum 84, to permit the vacuum chamber 97 to be communicated with the end surface of the rotary shaft 83. A vacuum pipe 101 is connected at its one end to the communication bore 99 opening at the end surface of the rotary shaft 83, through a rotary coupling 100. The other end of the vacuum pipe 101 is connected to a vacuum pump 102. Namely, in this embodiment, the leading end of the thin metal sheet 22 cooled and solidified on the drum 20 is trapped by the vacuum suction force which is imparted by the attracting ports 98 through the operation of the vacuum pump 102 thereby to start to take up the thin metal sheet 22 on the surface of the drum 84. The operation of the vacuum pump 102 is commenced at the moment at which the leading end of the thin metal sheet 22 has arrived at the take-up drum 84 and is stopped after several turns in which an adequate initial coil compacting force is created. The use of the vacuum suction type attracting means offers an advantage that the taking-up is smoothly made even when the thin metal sheet 22 is made of a material which cannot be attracted electromagnetically.

Figure 5:
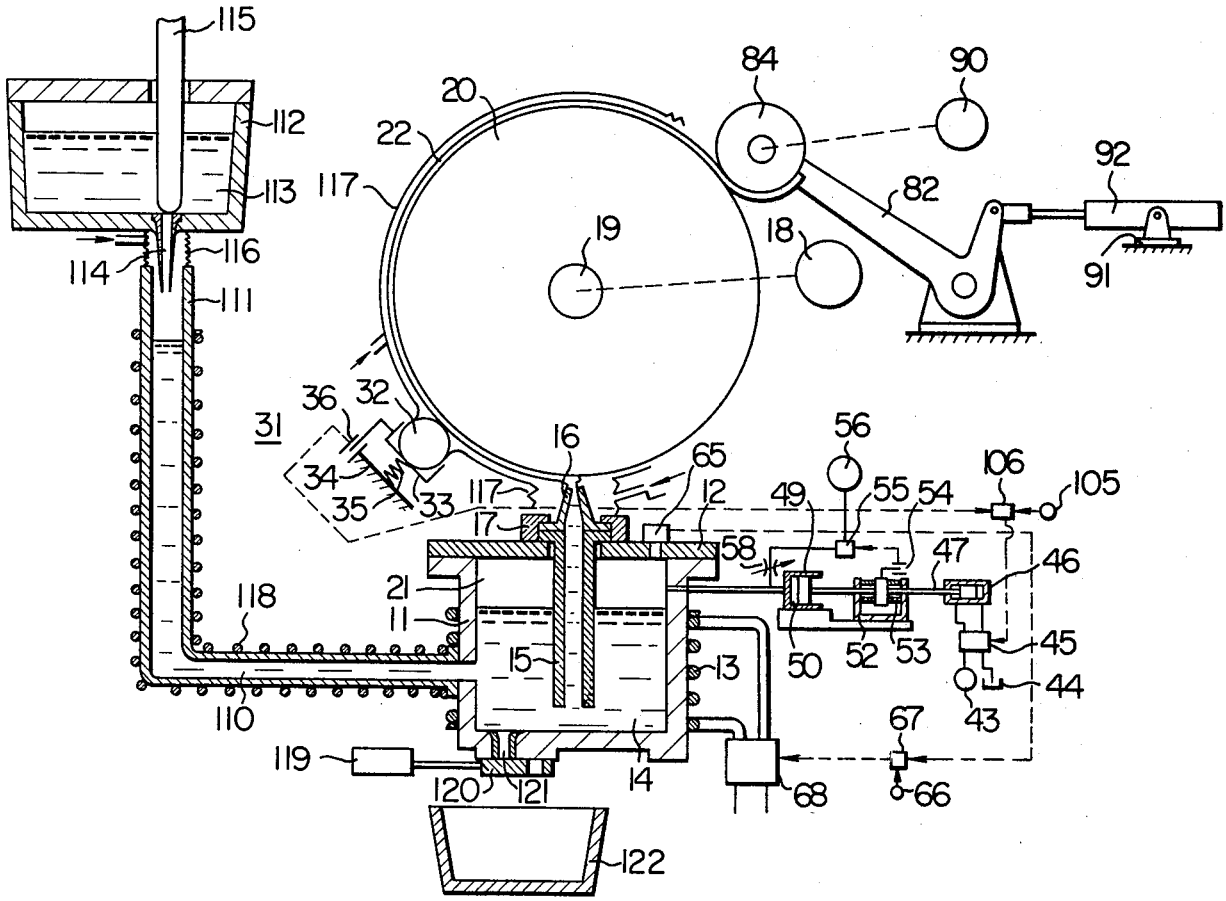
FIG. 5 shows, partly in section, the whole part of another embodiment of the invention equipped with a molten metal supplying device.

For achieving a continuous production of the thin metal sheet, it is necessary to continuously supply the crucible with molten metal. Hereinafter, a description will be made as to another embodiment of the invention equipped with a molten metal supplying device, with specific reference to FIG. 5 in which the same reference numerals are used to denote the same parts or members as those in FIG. 1. The apparatus shown in FIG. 5 incorporates controllers for controlling the peripheral speed of the drum and the torque of the take-up drum which are neglected from FIG. 5. This embodiment differs from the preceding embodiments in the manner of application of the molten metal from the molten metal application nozzle. More specifically, the outputs from a thickness setting device 105 and the output from the thickness sensor 31 is compared with each other by the thickness controller 106, and the application of the molten metal is made while adjusting the internal pressure of the crucible such that the difference between these two outputs are negated.

The characteristic portions of this embodiment will be described in detail hereinunder. A conduit 110 connected to the side wall of the crucible 11 makes a gas-tight communication with the molten metal in the crucible. The outer or inlet end 111 of this conduit 110 is positioned at a level above the level of the molten metal 14 in the crucible. The molten metal is delivered to the inlet 111 of the conduit 110 continuously or intermittently by a laddle 112. The rate of the delivery is controlled by an outlet pipe 114 and a stopper 115.

The inlet 111 of the conduit 110 is covered by a seal 116 the interior of which is filled with an inert gas such as argon, to prevent the oxidation of the molten metal and introduction of bubbles.

Also, a seal 117 is provided around the periphery of the molten metal application nozzle 16 and around the periphery of the thin metal sheet on the drum 20. The interior of this seal is also filled with an inert gas such as argon, thereby to prevent the oxidation of the molten metal and thin metal sheet. Heaters 13 and 118 connected to the power supply 68 are disposed around the crucible 11 and the conduit 110 to maintain a predetermined temperature of the molten metal. To make the control of the molten metal temperature, the temperature sensor 65 attached to the cover 12 of the crucible is fed back to the power supply 68.

The crucible 11 is provided at its bottom with a discharge port 121 which is adapted to be opened and closed by a valve 120 driven by a cylinder 119. This discharge port 121 is opened to release the residual molten metal into a box 122, when it is required to evacuate the crucible 11 completely, as in the case of the cleaning of interior of the crucible 11.

In this embodiment having the described construction, it is possible to maintain a substantially constant level of the molten metal 14 in the crucible, during the production of thin metal sheet by applying the molten metal to the surface of the drum 20, by delivering the molten metal continuously or intermittently to the conduit 110 through the control of the opening and closing of the aforementioned stopper 115. Thus, the suspension of operation of apparatus during the supply of molten metal to the crucible, which has been necessary in the conventional apparatus, is eliminated in the apparatus of the described embodiment, because the supplement of molten metal is continuously made up to permit the continuous production of the thin metal sheet, by the supply of molten metal into the crucible through the conduit 110 which is communicated with the molten metal 14 in the crucible 11 in a gas-tight manner.

The connection of the conduit 110 to the side wall of the crucible 11 is not essential and the conduit 110 can be connected in a gas-tight manner also to the top, i.e. the cover 12, of the crucible. In such a case, the conduit 110 is projected into the crucible 11 and extended downwardly to a level sufficiently below the surface of the molten metal 14.

As has been described, in this embodiment, a substantially constant molten metal level is maintained in the crucible during the production of the thin metal sheet, because the molten metal is continuously supplied into the crucible of gas-tight construction. Consequently, the head of the molten metal in the crucible is maintained substantially constant, so that the flow velocity of the molten metal from the nozzle is maintained constant to ensure a uniform thickness of the product thin metal sheet. In addition, since the molten metal is supplied in a gas-tight manner, the contamination of molten metal by foreign matters brought by bubbles or the like is avoided and the oxidation of the molten metal is prevented to ensure a high quality of the product thin metal sheet.

Furthermore, the intermittent or continuous supply of separately prepared molten metal into the crucible permits the molten metal to be continuously applied to the drum without suspension, ensuring a remarkable improvement of the production efficiency.

What is claimed is:

1. An apparatus for producing thin metal sheet, comprising:

a nozzle;

a rotary drum;

means for rotating said drum and applying molten metal to the peripheral surface of said rotary drum through said nozzle at a predetermined application pressure, and allowing said molten metal to be cooled and solidified on said peripheral surface of said rotary drum to produce a thin metal sheet as said drum rotates;

crucible means for containing the molten metal;

an inlet end of said metal nozzle extending into said crucible means to be immersed in the molten metal;

said crucible means having a gas plenum formed in its upper portion above the molten metal;

a gas-pressure chamber device of a variable volume and fluid communicating with said gas plenum;

thickness sensor means to produce a signal correlated to the thickness of said thin metal sheet;

means responsive to said signal to produce a control instruction;

controlling means adapted to cause a change of volume of said gas-pressure chamber device to adjust the pressure in said gas plenum, in accordance with the control instruction formed in response to the output of said thickness sensor means sensitive to the thickness of said thin metal sheet, thereby to control the rate of application of said molten metal in accordance with the change of thickness of said thin metal sheet; and said controlling means including a mechanical actuator drivingly connected to said expansible chamber device and having means for increasing the spring constant of said actuator.

2. An apparatus for producing thin metal sheet as claimed in claim 1, wherein said actuator is constituted by a hydraulic cylinder, while said means for increasing the spring constant is constituted by a rubbery resilient body mounted to resist displacement of said hydraulic cylinder.

3. An apparatus for producing thin metal sheet as claimed in any one of claims 1 and 2, wherein said gas-pressure expansible chamber device is constituted by a gas cylinder.

4. An apparatus for producing thin metal sheet as claimed in any one of claims 1 and 2, wherein said thickness sensor means is disposed in the region of said peripheral surface of said rotary drum in which said thin metal sheet is held in contact with said peripheral surface of said rotary drum.

5. An apparatus for producing thin metal sheet as claimed in claim 4, wherein said thickness sensor means is adapted to measure the thickness of said thin metal sheet making use of said outer peripheral surface of said rotary drum as a reference.

6. An apparatus for producing thin metal sheet as claimed in claim 4, wherein said thickness sensor includes a contact roller means to press said thin metal sheet onto said peripheral surface of said rotary drum, and a detector means to detect the displacement of said contact roller means.

7. An apparatus for producing thin metal sheet as claimed in claim 4, wherein said thickness sensor includes a non-contact type measuring device adapted to measure the distances of said peripheral surface of said rotary drum and the surface of said thin metal sheet from a common reference point previously set in said thickness sensor, said thickness of said thin metal sheet being measured as the difference between said distances.

8. An apparatus for producing thin metal sheet as claimed in claim 6, wherein said thickness sensor means is adapted to measure the thickness of said thin metal sheet making use of said outer peripheral surface of said rotary drum as a reference.

9. An apparatus for producing thin metal sheet as claimed in claim 7, wherein said thickness sensor means is adapted to measure the thickness of said thin metal sheet making use of said outer peripheral surface of said rotary drum as a reference.

10. An apparatus for producing thin metal sheet, comprising:

a nozzle;

a rotary drum;

means for rotating said drum and applying molten metal onto the peripheral surface of said rotary drum through said nozzle at a predetermined application pressure, and allowing said molten metal to be cooled and solidified on said peripheral surface of said rotary drum, to produce a thin metal sheet;

sheet take-up means disposed directly adjacent to said rotary drum for continuously winding said thin metal sheet from said rotary drum into a coil, said sheet take-up means including a take-up drum disposed to be able to contact said peripheral portion of said rotary drum, attracting means to commence the taking-up operation for attracting the leading end of said thin metal sheet for winding said thin metal sheet from said rotary drum into a coil, and means for moving said take-up drum away from said rotary drum as the thin metal sheet is coiled on said take-up drum.

11. An apparatus for producing thin metal sheet as claimed in claim 10, wherein said take-up drum is provided on its peripheral surface with said attracting means, and said attracting means including a magnet adapted to catch the leading end of said thin metal sheet.

12. An apparatus for producing thin metal sheet as claimed in claim 10, wherein said take-up drum is provided with said attracting means, and said attracting means including a vacuum chamber formed in said take-up drum and a multiplicity of attracting ports formed in the cylindrical wall of said take-up drum, said attracting ports providing communication between said vacuum chamber and the peripheral surface of said take-up drum.

13. An apparatus for producing thin metal sheet as claimed in claim 10, wherein said moving means moves said take-up drum radially away from said rotary drum as the thin metal sheet is coiled on said take-up drum to compensate for the increasing diameter of said roll.

14. Continuous casting apparatus for producing thin metal sheet, comprising:

a nozzle;

a rotary casting drum mounted for rotation about a fixed casting axis relative to said nozzle, and a peripherally spaced take-up position, with the casting drum surface immediately adjacent said take-up position being the sheet releasing portion of said casting drum and only the casting drum surface between said nozzle and said take-up position being the casting portion of said casting drum;

means for rotating said casting drum and continuously applying molten metal directly onto the peripheral casting surface of said rotary casting drum through said nozzle at a predetermined application pressure, and cooling and solidifying said molten metal on said peripheral casting surface of said casting drum, to continuously produce a thin meal sheet at said take-up position;

sheet take-up means disposed directly adjacent to said rotary drum for continuously winding said thin metal sheet from said rotary casting drum directly into a coil; and said sheet take-up means including a take-up drum mounted for rotation about a take-up axis parallel to and spaced from said casting axis, said take-up drum being bodily mounted for movement together with its axis between a starting position wherein said take-up drum is in contact with the sheet releasing portion of said casting drum and a second position spaced a distance from said casting drum equal to the desired coil thickness;

said take-up means including attracting means on the surface of said take-up drum to commence the taking up operation for attracting the leading end of said thin metal sheet when said take-up drum is in said starting position for winding said thin metal sheet from said rotary casting drum directly into a coil on said take-up drum; and said sheet take-up means further including means for pressing said take-up drum toward said casting drum and for moving said take-up drum away from said rotary drum toward said second position as the thin metal sheet is coiled on said take-up drum to compensate for the increasing diameter of said coil.

15. The casting apparatus as claimed in claim 14, further including:

a casting motor drivingly connected to said casting drum for rotating said casting drum about said casting axis;

said take-up means including a take-up motor separate from said casting motor and drivingly connected to said take-up drum for rotating said take-up drum about said take-up axis throughout its movement between said starting position and said second position; and control means for controlling said take-up motor to maintain a constant torque drive for said take-up drum.

16. The casting apparatus as claimed in claim 14, wherein said attracting means includes magnetic means around the entire peripheral surface of said take-up drum for producing a magnetic field to attract the leading end of the thin metal sheet, catch the same during starting of winding and maintaining the leading end in contact with the take-up drum during the formation of a coil of thin metal sheet on said take-up drum.

17. The casting apparatus as claimed in claim 14, wherein said attracting means forms a vacuum on said take-up drum surface to catch the leading end of the thin metal sheet during starting and hold the same on said take-up drum during the formation of a coil of said thin metal sheet on said take-up drum.

* * * * *